US006220887B1

(12) United States Patent
Downs

(10) Patent No.: US 6,220,887 B1
(45) Date of Patent: Apr. 24, 2001

(54) STABILIZER FOR HOLDING CIRCUIT BOARDS IN A PORT

(75) Inventor: David C. Downs, Bloomfield Hills, MI (US)

(73) Assignee: Enclosure Technologies, Inc., Ypsilant, MI (US)

( * ) Notice: Subject to any disclaimer, the term of this patent is extended or adjusted under 35 U.S.C. 154(b) by 0 days.

(21) Appl. No.: 09/161,866

(22) Filed: Sep. 28, 1998

(51) Int. Cl.[7] ..... H01R 13/64
(52) U.S. Cl. ..... 439/377; 361/801
(58) Field of Search ..... 439/325–327, 439/342, 355, 377; 361/801

(56) References Cited

U.S. PATENT DOCUMENTS

| | | | | |
|---|---|---|---|---|
| 3,905,665 | | 9/1975 | Lynch et al. . | |
| 4,745,524 | | 5/1988 | Patton, III . | |
| 4,858,162 | | 8/1989 | Kieffer et al. . | |
| 4,964,810 | * | 10/1990 | Malotke et al. | 439/368 |
| 5,216,578 | | 6/1993 | Zenitani et al. . | |
| 5,227,957 | | 7/1993 | Deters . | |
| 5,317,483 | | 5/1994 | Swindler . | |
| 5,323,291 | | 6/1994 | Boyle et al. . | |
| 5,338,214 | | 8/1994 | Steffes et al. . | |
| 5,367,571 | | 11/1994 | Bowen et al. . | |
| 5,430,607 | | 7/1995 | Smith . | |
| 5,452,975 | | 9/1995 | Grant . | |
| 5,473,505 | | 12/1995 | Kessoku et al. . | |
| 5,544,006 | | 8/1996 | Radloff et al. . | |
| 5,575,546 | | 11/1996 | Radloff . | |
| 5,590,023 | | 12/1996 | Hernandez et al. . | |
| 5,601,349 | | 2/1997 | Holt . | |
| 5,640,309 | | 6/1997 | Carney et al. . | |
| 5,642,259 | | 6/1997 | Ma . | |
| 5,650,922 | | 7/1997 | Ho . | |
| 5,657,204 | * | 8/1997 | Hunt | 361/752 |
| 5,673,175 | | 9/1997 | Carney et al. . | |
| 5,715,146 | | 2/1998 | Hoppal . | |
| 5,730,610 | | 3/1998 | Hsia et al. . | |
| 5,734,551 | * | 3/1998 | Hileman et al. | 361/695 |
| 5,740,020 | | 4/1998 | Palatov . | |
| 5,748,453 | | 5/1998 | Carney et al. . | |
| 5,757,618 | | 5/1998 | Lee . | |
| 5,765,008 | | 6/1998 | Desai et al. . | |
| 5,781,414 | | 7/1998 | Mills et al. . | |
| 5,822,193 | * | 10/1998 | Summers et al. | 361/759 |
| 6,022,234 | * | 2/2000 | Shinoto et al. | 439/327 |

* cited by examiner

*Primary Examiner*—Khiem Nguyen
(74) *Attorney, Agent, or Firm*—Dykema Gossett PLLC

(57) ABSTRACT

A stabilizer for holding a circuit card in an electrical port is provided. The stabilizer includes a frame. A lever having a pivotal mounting with respect to the frame is included. The lever has a portion for making contact with an edge of the circuit card to urge the circuit card towards the electrical port. The stabilizer has a fulcrum to set an angle of inclination of the lever with respect to the frame. The fulcrum contacts the lever between the lever's pivotal mounting and the circuit card.

3 Claims, 3 Drawing Sheets

STABILIZER FOR HOLDING CIRCUIT BOARDS IN A PORT

FIELD OF THE INVENTION

This invention relates to an apparatus and method of utilization thereof of stabilizers mounting of circuit boards in an electrical port. More particularly, the present invention relates to a stabilizer for holding a circuit board or expansion card in an electrical port or expansion card socket of a personal computer.

BACKGROUND OF THE INVENTION

Personal computers such as the IBM family of personal computers and the so-called IBM clones or compatibles are produced with an "open architecture" design for allowing additional functions to be later added to the computer. As a result, a number of manufacturers produce various printed circuit boards or (sometimes called "I/O cards" or "expansion cards") which are mounted in the computer for later expanding its available functions. For instance, expansion cards can be installed in the computer to provide a hard disk drive controller, a color/graphics monitor, networking, memory expansion, printer ports, accelerator functions, modems, and the like.

In order to facilitate connection of expansion cards to the computer circuitry, the computer has a number of expansion slots on the rear panel of the computer chassis. The expansion slots have separate removable cover plates for radiation shielding and for serving as dust covers for the expansion slots. The expansion card has a long, narrow edge connector which projects from the bottom edge of the card and is plugged into an electrical port commonly referred to as an expansion card socket. The edge connection has a number of parallel metal plated male contacts which make contact with corresponding spring-loaded female contacts in the expansion card socket. The expansion socket may be ISA (Industry Standard Architecture) or the newer PCI (Preferred Component Interconnect) type socket. PCI sockets are usually physically longer than the older ISA sockets. Therefore, PCI circuit cards tend to be longer than ISA circuit cards. The cover plate originally used for the expansion slot is usually thrown away when the expansion card is added. The old cover plate is replaced by a fill-length mounting bracket fastened to the rear edge of the expansion card. This mounting bracket together with the card's connection to the socket at the base of the computer chassis provide a dual means of support at the bottom and rear edge of the card for stabilizing the expansion card (holding it in a fixed upright position) inside the unit. The mounting bracket also aids in resisting the tendency of the female contacts of the card socket pushing the male contacts of the expansion card out of the card socket.

The mounting bracket is a specially fabricated metal piece having a flat face to cover the expansion slot (to serve as the radiation shield and dust cover in place of the removed cover plate). The bracket also has a tab at its top for fastening to the top inside edge of the computer chassis by the screw that held the expansion slot's original cover plate in place. The manufacturer of the expansion card typically fastens the special mounting bracket to the expansion card during assembly of the expansion card. The bracket is rigidly fastened to the edge of the card by riveting or by fasteners such as screws.

The above-noted expansion card mounting system typically works fine in an office or home environment. In an office or home environment, the computer is generally isolated from vibration or shock. In industrial, transportation, and military applications, the computer can often be subject to shock or vibration which will cause the expansion card to dislodge or to vibrate and cause the male and female contacts to intermittently or permanently lose engagement. It would be highly desirable to provide a stabilizer which would prevent inadvertent dislodgement between the male and female contacts due to adverse environmental conditions.

SUMMARY OF THE INVENTION

To meet the above-noted desires, the revelation of the present invention is brought forth. In its preferred environment, the revelation of the present invention brings forth the freedom of stabilizing an expansion card in an expansion socket which during shock or vibration of the computer chassis. A preferred embodiment of the present invention provides a stabilizer for holding a circuit card in an electrical port includes a frame. A lever having a pivotal mounting with respect to the frame is provided. The lever has a portion for making contact with an edge of the circuit card to urge it towards the electrical port. The stabilizer has a fulcrum to set an angle of inclination of the lever with respect to the frame. The fulcrum contacts the lever between the lever's pivotal mounting and the circuit card.

The above noted and other features of the present invention will become apparent to those skilled in the art from a review of the following description and drawings.

DETAILED DESCRIPTION OF PREFERRED EMBODIMENTS

Figure 1:
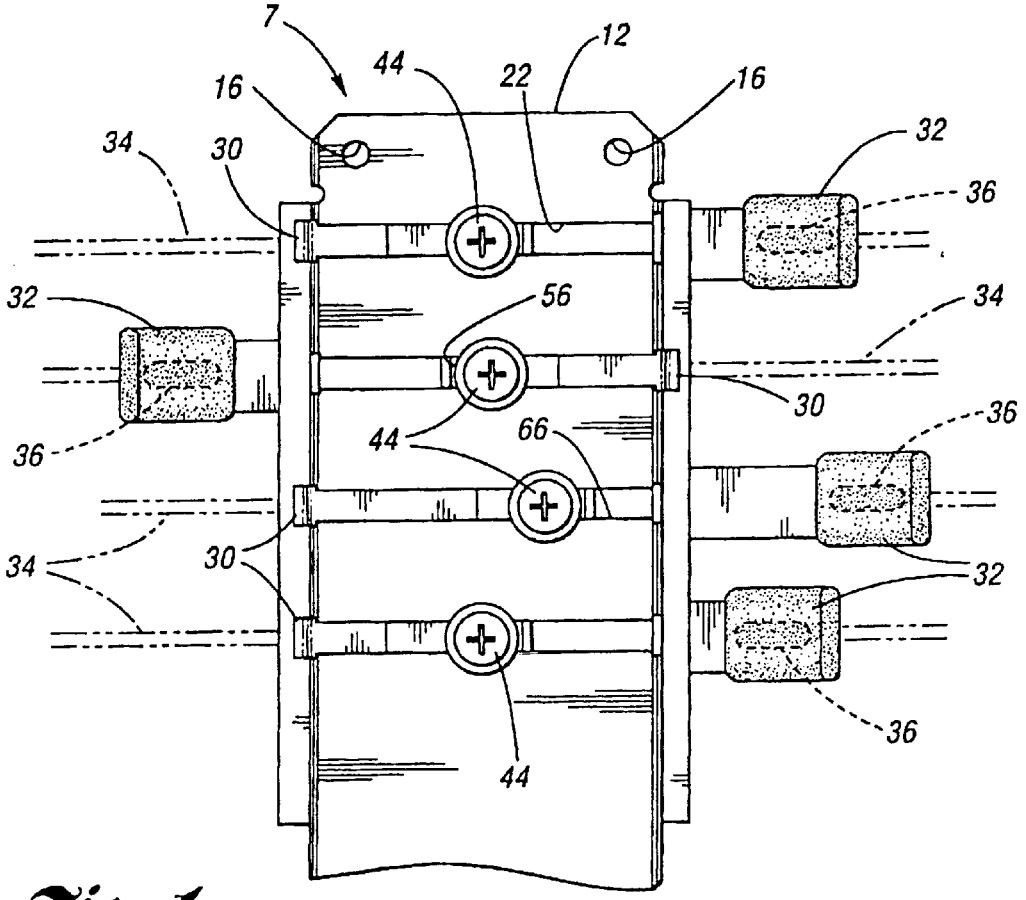
FIG. 1 is a top plan view of a preferred embodiment stabilizer for holding a circuit board of the present invention.
Figure 2:
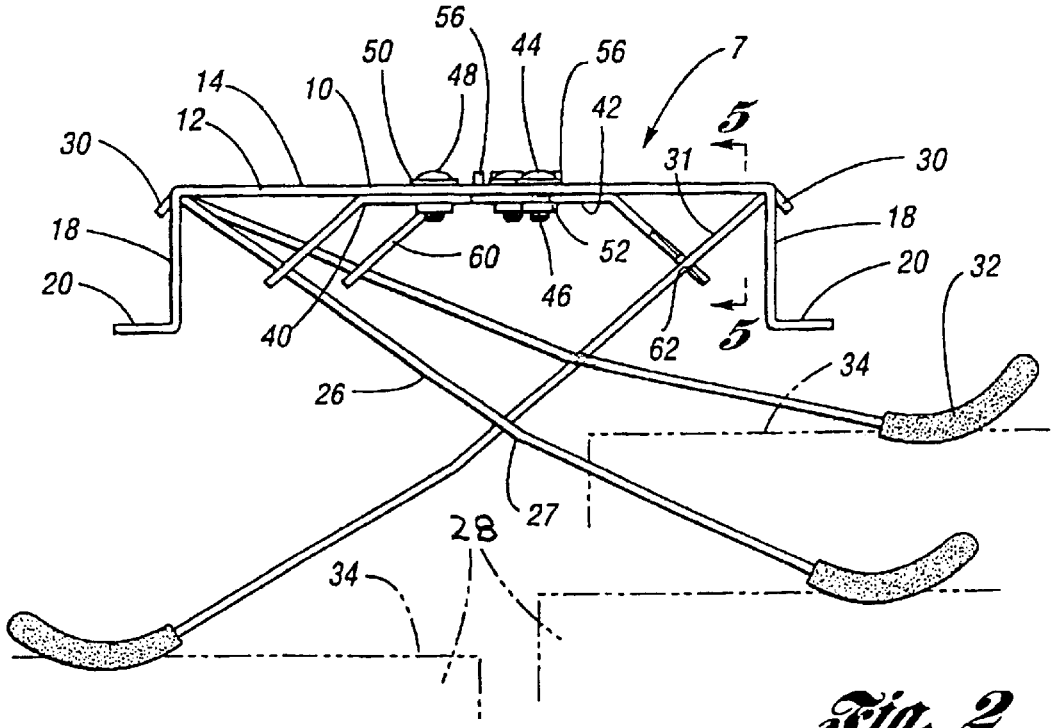
FIG. 2 is a side elevational view of the stabilizer shown in FIG. 1.
Figure 3:
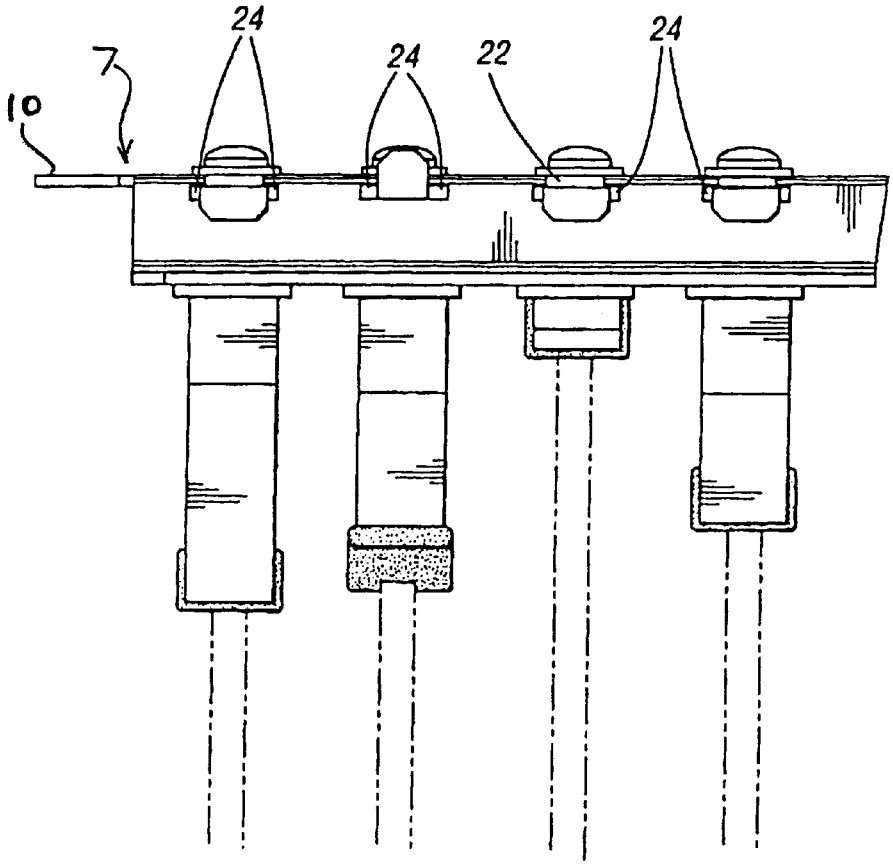
FIG. 3 is a front elevational view of the stabilizer shown in FIG. 1.
Figure 5:
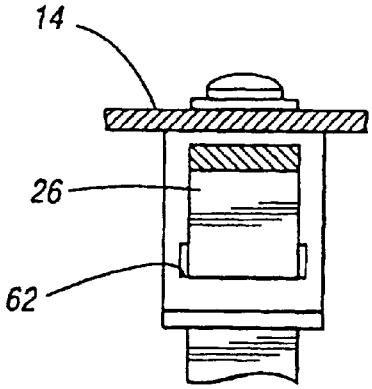
FIG. 5 is a view taken along line 5—5 of FIG. 2.
Figure 4:
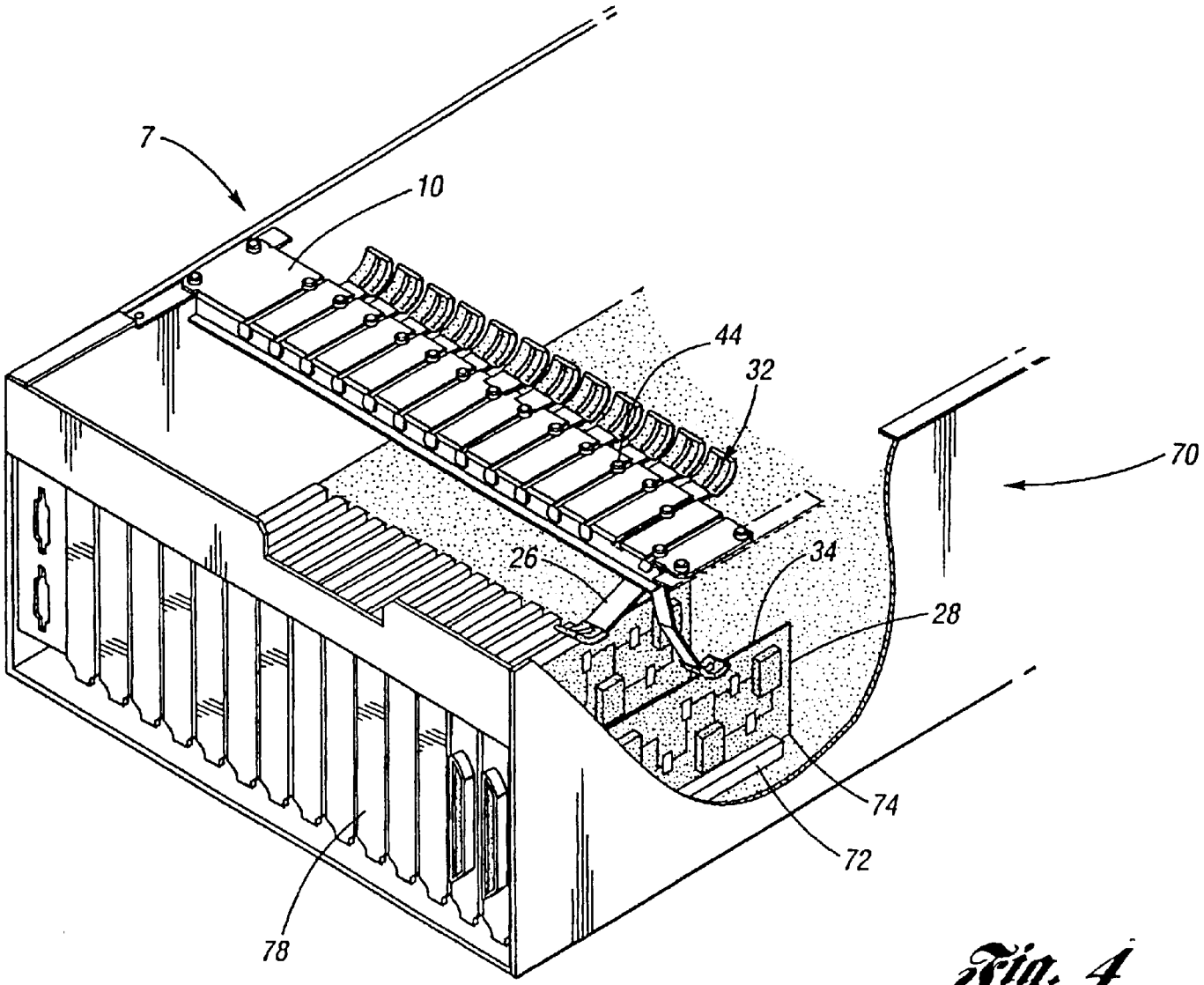
FIG. 4 is a perspective environmental view of the stabilizer of the present invention installed in a computer chassis.

Referring to FIGS. 1–5 the present inventive stabilizer 7 for holding a circuit card provides a frame 10. The frame 10 has a flat portion 12 having a first side 14 which is accessible to a technician after removal of a computer chassis top panel (not shown). The frame 10 has several apertures 16 allowing it to be secured within a chassis 70 (FIG. 4) of the computer chassis. Joining to the frame flat portion 12 are two generally perpendicular side walls 18. The side walls 18 have connected to them outwardly extending feet 20. The feet 20 provide extra additional stiffening to the frame 10.

The frame flat portion 12 has a series of generally parallel transverse slots 22. The transverse slots 22 of the frame intersect generally transversely widened slot portions 24 at an upper end of each side wall. The frame 10 is typically fabricated from a sheet metal with the slots 22 being formed before the side walls 18 are bent with respect to the flat portion 12.

Pivotally mounted with respect to the frame are a series of finger levers 26. As shown, there is one lever 26 for each slot 22. (Note: the uppermost lever 26 shown in FIG. 1 has been removed from FIG. 2 for clarity.) In the embodiment shown, each lever 26 is used to stabilize a single circuit card 28. The lever 26 has a bend 27. However, in an embodiment not shown, the lever is dimensioned to stabilize a plurality of circuit cards. The lever has at one end a tongue 30. The tongue 30 is bent with respect to the remainder of the lever and is inserted in one of the transversely widened slots 24. After insertion of the tongue 30, the lever 26 is pivotally mounted with respect to the frame 10. The tongue 30 is bent at 85° with respect to a lever upper end 31. The 5° overbend from perpendicular of the tongue 30 from lever upper end 31 aids in retention of the tongue 30 in the transversely widened slot 24 when the lever upper end 31 is closely angled with the frame side wall 28. The lever 26 is pivotal in a plane generally parallel and coplanar with the plane of the circuit card 28. The lever has a tip or a contact portion 32 for contact with the circuit card 28 along a top edge 34 of the circuit card 28. As shown, contact portion 32 has a convex curvature with respect to the circuit card 28. In the embodiment shown, the contact portion 32 is at an extreme end of the lever 26. The contacting portion 32 has a longitudinal groove or opening 36 which is typically aligned with the edge 34 of the circuit card to capture the circuit card 28. The contact portion 32 is also coated with an electrically insulating polymeric (preferably elastomeric) substance to electrically insulate the lever 26 from the card 28. Additionally, a web of the electric insulation in the longitudinal groove 36 of the lever contact portion 32 works to cushion and laterally stabilize the card 28 along its top edge 34.

Each lever 26 has associated therewith a support or fulcrum 40. The fulcrum is fabricated from sheet metal. The fulcrum has a first part 42 which is generally adjacent to the flat portion 12 of the frame opposite the frame first side 14. The first part of the fulcrum 42 is connected to the frame by a threaded fastener 44. The fastener 44 has a shank 46 which penetrates the slot 22. The fastener 44 has a head 48 on an opposite first side 14 of the frame flat portion which compresses a spring washer 50. The fastener threadedly connects with a flat washer 52 which juxtaposes the first part of the fulcrum 42 between the washer 52 and the frame flat portion 12. The first part of the fulcrum 42 also has an upturned stud 56 which allows a technician to move the fulcrum 40 along the slot for infinite adjustment of position. The stud 56 has a transverse dimension which is close to that of the width of the slot 22 and also aids in the prevention of the fulcrum rotating about the fastener 44. When a desired adjusted position is obtained, a screw driver is utilized to torque the head 48 of the fastener.

The fulcrum also has a second part 60 (FIGS. 2, 5) which is an example shown in integrally joined to the first part 42. The second part 60 has an inclination of approximately 45° with the flat portion 12 of the frame and is inclined in a direction towards the pivotal connection of the lever with the frame. The second part 60 has a closed slot 62 which the lever 26 extends through. The slot 62 of the fulcrum second part allows the fulcrum 40 to capture the lever 26 when no circuit card is inserted underneath. Upon insertion of a circuit card, the fulcrum 40, frame flat portion 12 and lever upper end 31 will form a triangular support structure to stabilize an underlying circuit card 28 in its electrical port (expansion socket 72).

In operation, the frame 10 with several lever and fulcrum combinations is installed into a chassis 70 of the computer. The frame 10 is accessible when top side panel (not shown is removed). When a new expansion card 28 is to be added to the computer and a prior expansion slot cover plate 78 along the rear panel of the computer is removed. A determination is made, based upon the size of and shape of the circuit card 28, and the exact location of the frame 10, on which end of the slot 22 to pivotally mount the lever 26 into transversely widened slot portion 24. The location of the expansion socket 72 will also effect which end of the frame 10 to suspend the lever 26 from. The fulcrum 40 is also installed in the approximate slot 22 with the fastener 44 untorqued. The expansion card 28 is then inserted through the expansion slot. The male edge contacts of the lower end 74 of the expansion card are inserted into the female spring loaded contacts of the expansion card socket 72. The lever 26 is placed over the installed expansion card 28 and the fulcrum 40 is adjustably positioned within the slot 22 to force the lever to contact a top edge 34 of the expansion card 8 along the elongated slot of the lever. After the circuit card 28 is secured, the fulcrum 40 is then fixably located in position along the slot 22 by a torquing the fastener 44.

While the invention has been particularly shown and described with reference to the preferred embodiments thereof, it is well understood by those skilled in the art that various changes and modifications can be made in the invention without departing from the spirit and scope thereof.

What is claimed is:

1. A stabilizer for holding a circuit card in an electrical port comprising:

a frame, the frame having a transverse slot;

a lever pivotally mounted with the frame in a plane generally coplanar with the circuit card having a portion for making contact with an edge of the circuit card to urge it towards the electrical port; and a fulcrum which captures the lever, the fulcrum being adjustably mounted on the frame with a first portion adjacent the transverse slot, and the fulcrum having a flat first part positioned adjacent the frame slot, and the fulcrum having a second part angled from the first part, and a fastener penetrating the slot with a head on a side of the frame opposite the first part of the fulcrum holds the first part of the fulcrum to the frame.

2. A stabilizer for holding a circuit card as described in claim 1, wherein the second part of the fulcrum is angled towards the pivotal mounting of the lever with the frame.

3. A stabilizer for a circuit card as described in claim 1, wherein the first part of the fulcrum has a stud which extends through the frame slot and is exposed on an opposite side of the frame.

* * * * *